United States Patent [19]

Erikson

[11] 4,156,568

[45] May 29, 1979

[54] PHOTOGRAPHIC SHEET POSITIONER FOR FILM PROCESSOR

[75] Inventor: Herman E. Erikson, Winchester, Mass.

[73] Assignee: Polaroid Corporation, Cambridge, Mass.

[21] Appl. No.: 841,888

[22] Filed: Oct. 13, 1977

[51] Int. Cl.[2] ..... G03D 9/02

[52] U.S. Cl. ..... 354/312; 354/277; 354/304

[58] Field of Search ..... 354/84, 85, 86, 88, 354/277, 303, 304, 312, 315

[56] References Cited

U.S. PATENT DOCUMENTS

| | | | |
|---|---|---|---|
| 3,854,812 | 12/1974 | Sorli | 354/84 |
| 3,896,469 | 7/1975 | Mather | 354/304 |
| 4,019,194 | 4/1977 | Cutler et al. | 354/312 |

*Primary Examiner*—L. T. Hix
*Assistant Examiner*—Alan Mathews
*Attorney, Agent, or Firm*—Edward S. Roman

[57] ABSTRACT

A photographic sheet positioner, which releasably mounts on a film processor, releasably holds a print sheet in a predetermined location in a slide tray and guides a photographic cassette along a path to feed an image-bearing film sheet therein into aligned engagement with the print sheet. A locator applies a selectively-releasable resilient locating bias on the two interengaged sheets in the slide tray. When mounted on the processor, the positioner presents the engaged sheets to processing elements which withdraw both sheets as a unit from the positioner, with one sheet being thereby withdrawn from the cassette, for conventional processing.

16 Claims, 7 Drawing Figures

PHOTOGRAPHIC SHEET POSITIONER FOR FILM PROCESSOR

BACKGROUND OF THE INVENTION

This invention relates to apparatus for mating an exposed photographic film sheet with a photographic print sheet, and for presenting the mated pair of sheets to a photographic processor. The photographic sheets are of the self-developing type. The invention is particularly useful with large format photographic sheets, for example photographic sheets with an eight inch by ten inch format.

The invention is described with specific reference to an embodiment that handles film after exposure to X-rays in a cassette as described in the commonly-assigned patent application of Herman E. Erikson entitled "X-Ray Cassette For Large Format Film", (Ser. No. 841,889) and filed on even date herewith. The disclosure of that application is incorporated herein by this reference. Features of the invention are, however, useful with photographic film other than X-ray film, and are not limited to use with that cassette.

It is commercially common practice with self-developing film to expose a large format photographic sheet in a cassette, to align the exposed sheet in register with a print sheet, and to feed the pair of sheets into the nip between a pair of rollers in a processor. Passage of the sheet through the rollers initiates photographic development of the latent image which the exposed film sheet bears, and fixes the image on the print sheet. The Polaroid Corporation type 8×10 Land Film Processor provides this operation with type 808 film and print sheets.

The conventional practice has been to introduce the print sheet to the cassette, and the processor withdraws the aligned sheets from the cassette. One prior practice uses a multi-sheet film assembly that includes both the film and the print sheets for simultaneous loading into the cassette. Another prior practice employs a print sheet which is a separate element from the film sheet and the operator feeds the print sheet into the cassette subsequent to exposure of the film sheet. In both instances, the sheets are selectively positioned within the cassette, which is then presented to the processor. The use of a multi-sheet film assembly lacks flexibility in film selection, is not readily suited for X-ray use, and tends to be more costly than the use of separate sheet elements. The prior use of separate sheets has the disadvantage of requiring that the operator feed the print sheet into the constricted light-tight passage of the cassette. This operation introduces an undue time delay between exposure of the film sheet and processing it. It can also result in the print sheet being wrinkled and even jammed in the cassette passage.

The film cassette which the above-identified concurrently-filed application describes houses a photographic film sheet for X-ray exposure but within a light-tight enclosure for daylight handling. Only a forward tab, a leader and an adjoining lead portion, of the film sheet are outwardly accessible. It is desired to transfer the exposed film sheet from the cassette to a presently-available processor in day-light, i.e., without darkroom protection. As required previously, the transfer is to be in conjunction with a print sheet.

Accordingly, it is an object of this invention to provide improvements in apparatus for positioning an exposed photographic sheet housed in a cassette for transfer from the cassette together with a print sheet, which like the photographic sheet is of the self-developing type, to a photographic processor.

A specific object is to provide positioning apparatus of the above character which readily aligns the cassette-housed film sheet with a print sheet.

Another object of the invention is to provide positioning apparatus of the above character for use with commercially-available processor units without refitting them.

It is another object of the invention to provide positioning apparatus of the above character which maintains the exposed film sheet under light-tight conditions for day-light use.

A further object of the invention is to provide positioning apparatus having the foregoing features which as an optional additional feature, automatically operates film clamping mechanism within the cassette to release the film sheet for ready withdrawal from the cassette and transfer into the processor.

Other objects of the invention will be obvious and will in part be set forth hereinbelow.

With the attainment of these other objects of the invention, a self-developing photographic film of large format can be exposed, either to visible light or to X-rays, whichever the case may be, and immediately processed, all within minutes. The handling of the film and print sheets is minimal and facile, and hence essentially without delay.

SUMMARY OF THE INVENTION

A film sheet positioner according to the invention attains the foregoing and other objects by providing a tray for receiving the print sheet and positioning the forward end in a slide ramp. A locator resiliently bears against the forward end of the print sheet within the slide ramp to releasably restrain forward movement of the print sheet and to locate the print sheet in a selected plane.

A guide passage receives the forward end of a cassette and guides the cassette to introduce a projecting forward tab of a film sheet therein to the slide ramp. The locator directs the film tab into engagement with the print sheet in the slide ramp. Specifically, in a typical embodiment, the leading forward end of the print sheet has a flap folded back on the sheet and is slotted at the fold. The locator directs the tab of the film sheet under the flap and through the slot to project forward of the print sheet.

The positioner seats the cassette with the film sheet aligned along the slide ramp. The film sheet tab is then accessible for engagement between processing rollers, for withdrawal of the film sheet from the cassette and transfer of both sheets together, in registration, into the processing nip of the rollers.

The invention also provides, as an option, an actuator for releasing a clamp mechanism within the film cassette. A releasable clamp mechanism is commonly provided in a large format film cassette for selective engagement with the film sheet, for example to ensure precise location of the film sheet at a selected film plane. Such a clamping mechanism typically has a release position for use during loading of the film sheet, is thereafter transferred to a clamping position, and is returned to the release position for removal of the film sheet. The optional actuator which the invention provides on the positioner automatically engages the clamp mechanism to transfer it to the release position.

With these and other features of the invention, an operator readies the positioner of one embodiment for use by plugging it into a conventional processor of self-developing film, and places a print sheet in a tray of the positioner. After exposure of a film sheet in a cassette, the operator inserts the cassette onto the processor. With this motion, the positioner automatically guides the forward-projecting tab of the film sheet into engagement with the print sheet and aligns the two sheets for simultaneous transfer to the processor. The entire operation can be done in open light and without special skills or training.

BRIEF DESCRIPTION OF DRAWINGS

These and other objects and features of the invention will be more fully understood from the following detailed description of an illustrative embodiment, together with the accompanying drawings in which.

DESCRIPTION OF ILLUSTRATED EMBODIMENT

Figures 1, 1A:
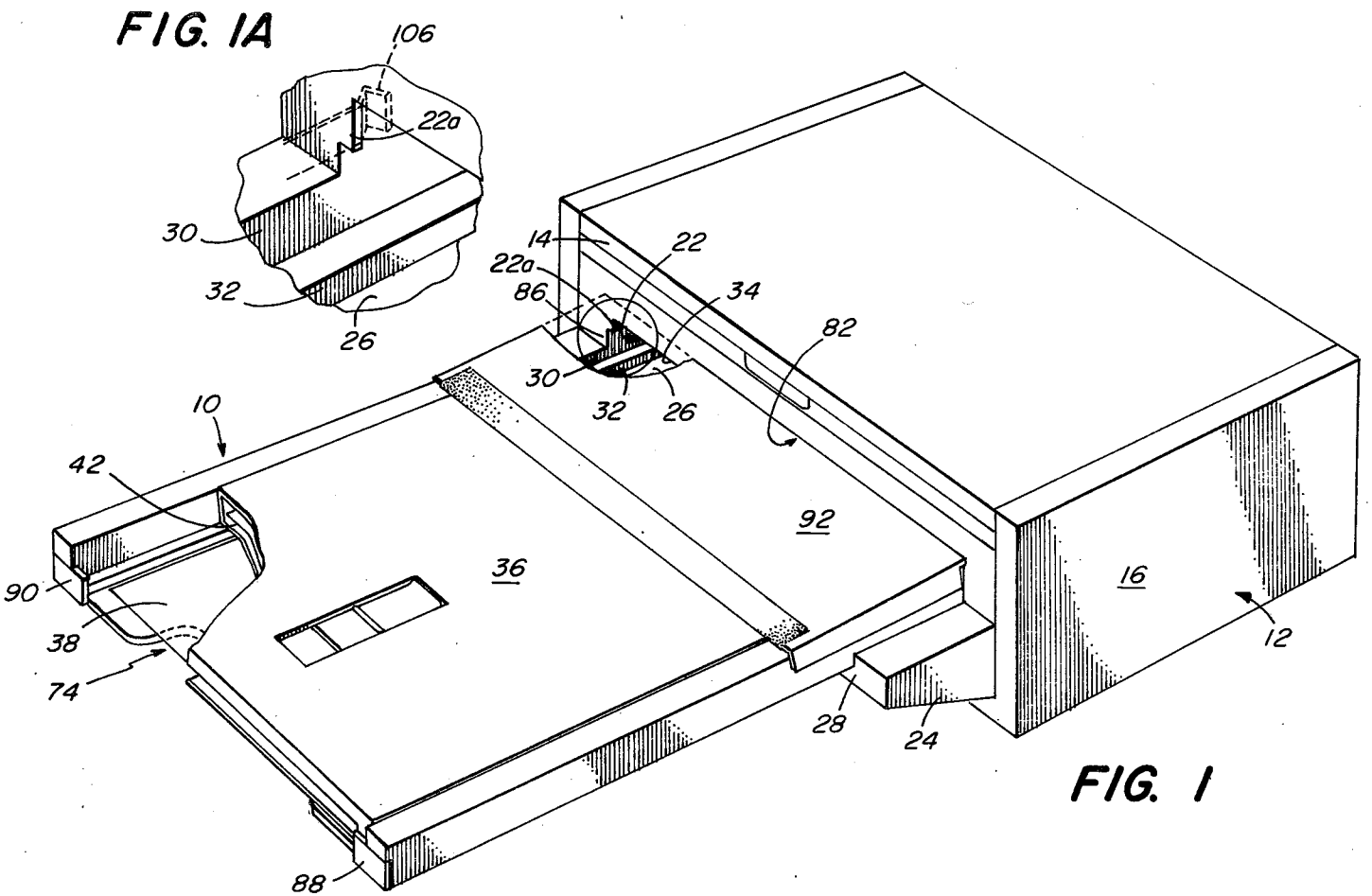
FIG. 1 is a perspective view, partly broken away, of a sheet positioner embodying the invention operatively mounted on a processor.
FIG. 1A is an enlarged perspective view of a portion of FIG. 1.
Figure 2:
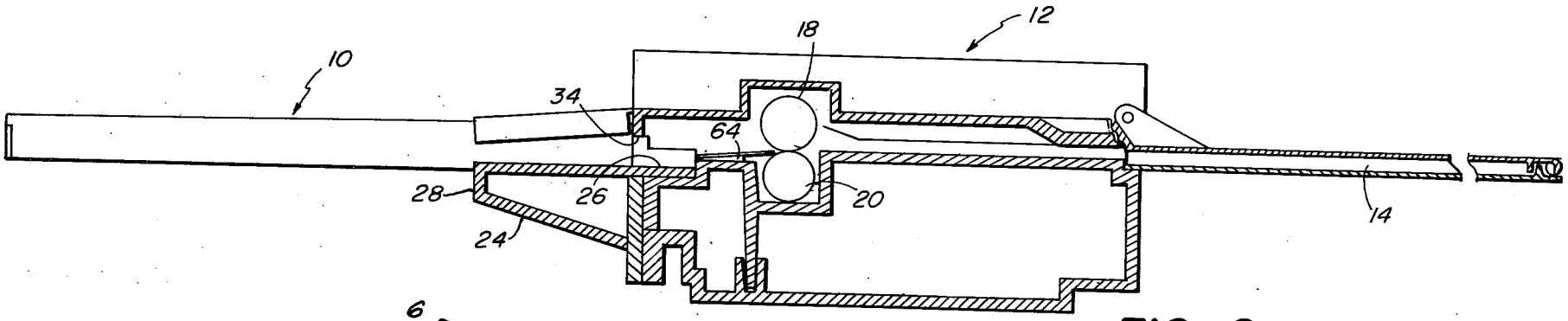
FIG. 2 is a simplified view in longitudinal section of the positioner and processor as shown in FIG. 1.

FIGS. 1 and 2 show a positioner 10 according to the invention mounted on a conventional processor 12 of self-developing film. The processor is of the type commercially available from Polaroid Corporation under the designation 8×10 Land Film Processor and is described in U.S. Pat. No. 4,019,194. FIG. 2 shows the processor with a film chamber 14 in the operative position; the chamber hinges over the processor as shown in FIG. 1 to form part of the housing 16. The processor housing 16 mounts a pair of processing rollers 18 and 20. These rollers engage photographic sheets presented to the processor at an entry 22 and draw them along a processing path which discharges them to the chamber 14, from which an operator removes the resultant photographic product. The processor housing includes an outwardly-projecting shelf 24 having a flat upper surface 26 that leads to the entry 22. The shelf has an outwardly-facing end wall 28 and has longitudinally-extending steps 30 and 32 extending along each side of the shelf surface 26. The entry 22 is thus of general rectangular configuration defined by the stepped sides and the flat surface 26 opposite a flat roof 34. The processor 12 typically also has detent-engaging latching -protrusion 22*a* on each side of the entry 22.

With further reference to FIGS. 1 and 2, the illustrated positioner 10 engages the processor elements 22, 24, 26 28, 30, 32 and 34 to attach to the processor and to seal the entry 22 from light. The positioner is a tray-like device for seating a film cassette 36 in registration above a print sheet 38. Insertion of the cassette into seated engagement with the positioner feeds a forward tab and a leader of the film sheet 42 therein into engagement with the print sheet 38. The positioner presents the inter-engaged sheets 38 and 42 to the processor for engagement and forward transport by the rollers 18 and 20.

Figure 3:
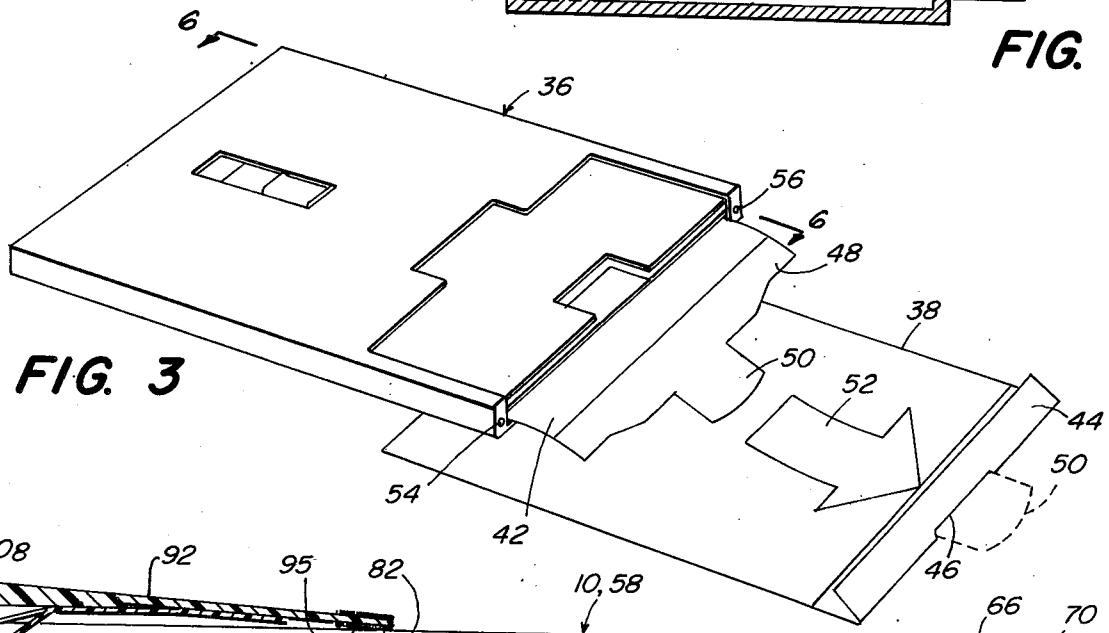
FIG. 3 is a pictorial showing of the operation of the positioner with a print sheet and a cassette carrying a film sheet.

FIG. 3 shows a cassette 36 and a print sheet 38 and illustrates this operation of the positioner with the film and print sheets. The illustrated print sheet 38 is shown disposed flat, as it is in the normal disposition of the positioner. The sheet, for the purposes of the present invention, is a large format photographic sheet with a forward leader having a fold 44 at the forward end and, in the middle of the sheet, a slot 46 aperturing the sheet at the crease which forms the fold 44. The photographic elements and structure of the sheet 38 are described further in the above-noted concurrently-filed application and, by way of illustration, can be the Polaroid Corporation type 808 film product. The cassette 36 has a flat box-like configuration, as also detailed in the above-noted concurrently-filed application, and houses a large format film sheet 42 which has, located outside the cassette, a forward leader 48 from which a flat tab 50 extends at the middle of the sheet. Upon insertion of the cassette 36 into the positioner 10, and to the seated condition which FIGS. 1 and 2 show, the positioner guides the tab 50 and the leader 48 along a path 52 shown in FIG. 3 to pass under the fold 44 of the print sheet. It guides the tab further to pass through the slot 46 to protrude beyond the print sheet as shown dotted in FIG. 3. The film sheet 42 is now engaged with the print sheet 38, and a forward pull, further along the path 52, on the film sheet tab will bring both sheets forward together. This is the action which the processor 12 rollers carry out. It will be noted that the cassette 36 extends longitudinally in a direction parallel to the direction in which it is inserted into the positioner 10, as well as to the direction in which the film sheets advance upon being drawn into the processor.

Figure 6:
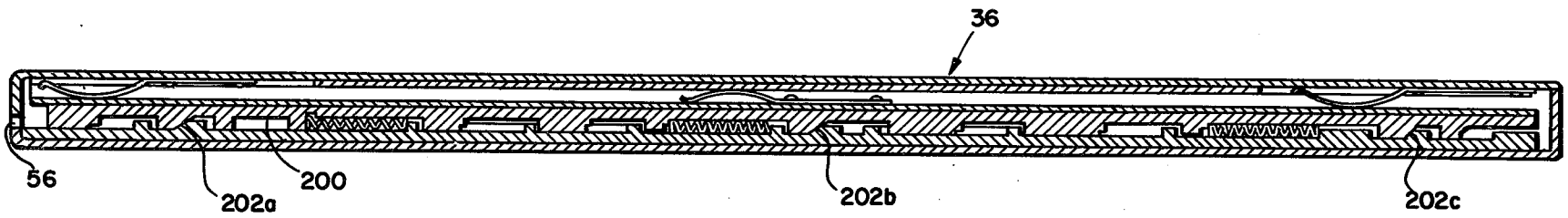
FIG. 6 is a cross-sectional view taken along the lines 6—6 of FIG. 3.

The cassette 36 which FIG. 3 illustrates has, in addition, holes 54 and 56 at the front end along the lateral sides. As discussed below, upon seating the cassette in the positioner 10, an actuator of the positioner projects into each hole to release a film-clamping mechanism including a pair of longitudinally slidable operating rods one of which is shown at 200 operatively connected to cam surfaces 202*a*, 202*b*, 202*c* as shown in FIG. 6 for relieving a clamping pressure on the film sheet 42 in the cassette and thereby releasing the film sheet 42 for ready removal from the cassette.

Figure 5:
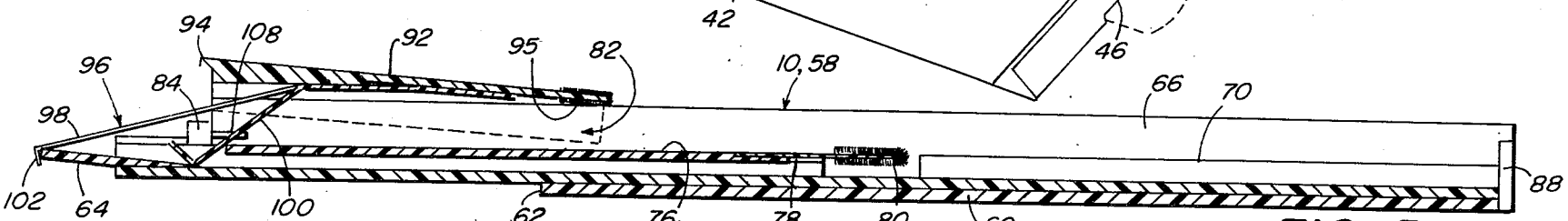
FIG. 5 is a view in longitudinal section of the positioner shown in FIG. 4.
Figure 4:
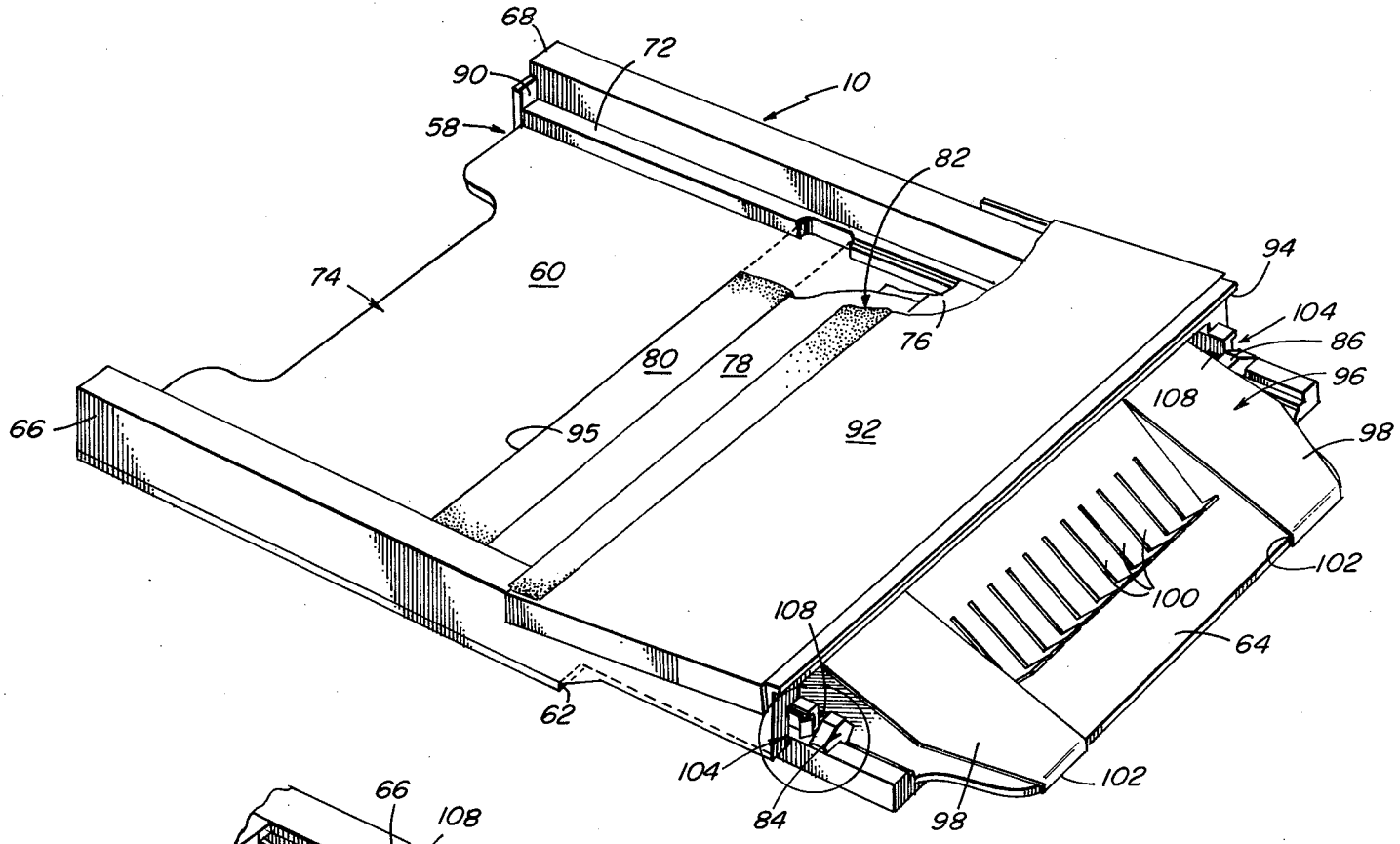
FIG. 4 is a perspective view, partly broken away, of the positioner shown in FIG. 1 including an inset showing a detail of a latch.
Figure 4A:
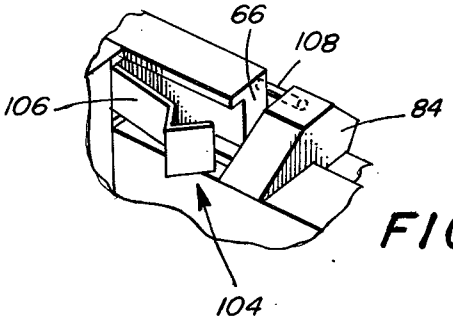
FIG. 4A is an enlarged perspective view of a portion of FIG. 4.

With reference to FIGS. 4 and 5, the positioner 10 has a tray-like body 58 with a bottom panel 60 that is flat inside and flat outside, except for a step 62 extending from side-to-side and which abuts the processor end wall 28 when the positioner is mounted on the processor. An upwardly-canted frontal lip 64 projects forward from the bottom panel 60; there is a further step at the juncture of the panel with the lip. Opposed sidewalls 66 and 68 extend along the length of the bottom panel of the processor body. The inner surfaces of the sidewalls are stepped to form shelves 70 and 72, respectively, raised above the inner surface of the bottom panel 60.

The inwardly-flat bottom panel 60 and the shelf-forming steps form a positioner slide tray 74 that receives the print sheet 38. The bottom and side walls of the slide tray locate the print sheet and further elements discussed below limit the forward positioning of the print sheet in the slide tray and hold the frontal end of the print sheet down into the bottom panel and lip 64.

A dividing panel 76 spans between the sidewall steps along approximately the forward half of the processor body 58 and hence over the forward portion of the slide tray 74. A stiffly-resilient sheet 78 fitted with a light-shielding fabric-like pile 80 spans between the sidewalls along the back edge of the dividing panel. The dividing panel, the resilient sheet and the pile 80 are optically absorbent (non-reflective and black in color) and form the bottom wall of a light tunnel which seals light from the film sheet during the transfer from the cassette to the rollers of the processor.

The positioner 10 receives the forward end of a cassette 36 within a guide passage 82 and seats the fully-inserted cassette directly above the slide tray 74, as FIG. 1 shows. When thus seated, the cassette rests on the shelves 70, 72 and is contained between the sidewalls 66, 68; it thus is positioned above the dividing panel 76, sheet 78 and fabric pile 80. To position the cassette longitudinally, a stop 84, 86 projects inward from each sidewall 66, 68, respectively, at the forward end of the body 58 and stops 88, 90 project similarly at the back end. These stops abut the front and the back edges of the seated cassette (FIG. 1).

The guide passage 82 is formed by the sidewalls 66 and 68, the shelves 70, 72 and a cover 92. The cover 92 spans between and is secured to the sidewalls and is internally dimensioned to constrain the cassette to rest on the shelves 70, 72. The outside of the illustrated cover flares upward to dispose a forwardly-projecting cover lip 94 nested under the roof 34 of the processor entry 22 when the positioner is mounted on the processor as in FIGS. 1 and 2. In addition, a light-sealing fabric pile 95 is provided on the underside of the cover 92, along the back edge thereof, to seal against the top of a cassette 36 seated in the positioner 10.

The positioner 10 thus seals the processor entry 22 from light, and provides a light-tight passage for the transport of a film sheet from a cassette seated therein to the processor rollers. The cover 92, with the lip that interfits under the processor entry roof and with the sealing pile 95, form the top elements of the light-tight barrier. Frontal edges of the positioner sidewalls 66 and 68, which interfit within the processor entry, form the sides of the light-shielding barrier; and the bottom elements of the light barrier include the frontal lip 64 of the positioner body, the dividing panel 76, and the resilient sheet 78 with the sealing pile 80. In addition, all surfaces which might reflect light toward the interior of the positioner or the processor entry preferably have a non-reflective light-absorbing paint or other coating.

A significant further element of the positioner 10 is a locator 96 that, as noted above, releasably restrains the forward position of a print sheet 38 in the slide tray 74, and that, upon insertion of a cassette 36, guides the leader 48 and the tab 50 of the film sheet 42 therein under the print sheet fold 44, as discussed above with reference to FIG. 3. The illustrated locator, shown in FIGS. 4 and 5, has two sets of fingers 98 and 100 which extend downward from the roof 92. Fingers 98, which in the illustrated embodiment are at each side of the slide tray 74, extend across the path of a print sheet at the front of the slide tray to just beyond and below the frontal lip 64. Each finger terminates with a downwardly-angled hoe-like blade 102 which is thus disposed forward of the lip 64 and extends below it. With this configuration, the blade of each finger 98 catches the leading edge of the print sheet being inserted into the slide tray 74 and resists further forward movement of the sheet. Upon feeling this resistance, the operator knows that the print sheet is fully inserted in the slide tray. However, upon further forward urging of the print sheet, as by the processor rollers, the fingers 98 flex sufficiently and yield to release the engagement with the print sheet.

The fingers 100, which resiliently bear against the bottom of the slide tray 74, are located between the fingers 98 and hence along the mid-region of the slide tray 74. These fingers are positioned to bear on a print sheet 38, when fully inserted in the slide tray, just behind the fold 44. The print sheet typically has a rupturable pod of processing fluid located directly behind the fold 44, and then the fingers 100 bear on it. With this arrangement of the fingers 100, they position the leading edge of the print sheet downwardly against the slide tray and they deflect and guide the tab 50 and the leader 48 of the film sheet to enter the fold 44, as described above with reference to FIG. 3. They also direct the forward leading edges of the mated print and film sheets toward the nip of the processor rollers.

In the construction illustrated, a single plate of stiffly-resilient synthetic sheet provides all the fingers 98 and 100 of the locator 96. The sheet is secured to the inside of the roof 92 and is cut and creased to form the several fingers, with the blades 102, as shown.

The inset in FIG. 4 shows in detail one of two latches 104 on the positioner 10 which secure it to the processor 12. Each illustrated latch 104 has a cantilevered-spring detent 106 secured to the sidewall 66, 68 at the forward end of the tray-like body 58. Each detent projects normally outward from the sidewall, but is deflectable inward, into a sidewall recess, against the resilient force of the cantilever spring.

Upon full mounting engagement of the positioner body with a processor as shown in FIGS. 1 and 2, each latch 104 seats behind a protrusion **22*a* present on the processor 12 along the sidewall of the entry 22, as the inset of FIG. 1 shows. The snap-like engagement of the positioner latching detent with a mating latching protrusion of the process secures the two mechanisms in the desired operative alignment. The mounting engagement is, however, readily releasable upon application of a sharp force directed to separate the positioner 10 from the processor 12**.

The illustrated positioner 10 has an optional feature that releases a film-clamping mechanism in a film cassette. By way of example, the above-noted concurrently-filed application describes such a clamping mechanism within an X-ray cassette. The clamping mechanism has a release position in which it is essentially free from engagement with a film sheet being loaded into or removed from the cassette. The clamping mechanism is movable to a clamping position, where it presses the film sheet to enhance intimate and continuous abutment of the sheet with a phosphorescent screen, and to enhance attaining a flat film sheet configuration fixed at the film plane. The cassette 36 shown in FIG. 3 includes such a clamping mechanism which is placed in the release position by means of actuating pins which enter the cassette holes 54, 56 (FIG. 3). This can be the sole actuator for releasing the clamping mechanism, or it can be a secondary, backup release actuating mechanism, as desired.

As FIGS. 4 and 5 show, the positioner 10 has an actuator for placing such a cassette-housed film sheet-clamping mechanism in the release position. The actuator is structured as an actuating pin 108 mounted on the tray-like body 58 in the cassette-receiving guide passage 82. Each pin extends longitudinally backward, i.e. toward a direction from which a cassette is loaded into the positioner. Each pin 108 is fixed on one stop 84, 86 and accordingly is located directly above one shelf 70, 72.

An operator uses the positioner 10 by mountingly fitting it onto a processor 12 in the manner shown in FIGS. 1 and 2, and with the detent-type latch 104 (FIG. 4) snapping into mating engagement with elements of the processor. A print sheet 38 (FIG. 3) is placed on the slide tray 74 with the forward edge engaged under the fingers 98 of the locator 96. The print sheet can be loaded into the slide tray prior to mounting the positioner onto a processor or thereafter, as this operation is independent of the mounting of the positioner onto a processor.

A cassette 36 (FIG. 3) can likewise be seated onto the positioner 10 independent of whether the positioner is mounted on a processor 12, but in most instances it is more convenient to load the cassette after the positioner is mounted on a processor. The cassette, however, is seated only after a print sheet is positioned in the slide tray 74. The cassette 36 is seated by first making certain that the forward tab 50 and forward leader 48 (FIG. 3) of the film sheet 42 therein are projecting forward from the cassette. The cassette is then inserted into the positioner guide passage 82 with the film sheet tab and leader forward, i.e. directed toward the processor 12. Continued forward insertion of the cassette into the slide passage brings the film tab and leader into engagement below the fingers 100 of the locator 96, which directs them downward under the fold 44 of the previously-loaded print sheet 38 (FIG. 3). As the forward edge of the cassette 36 is placed in the fully-inserted position, i.e. in abutment with the stops 84, 86 the film sheet tab 50 passes through the print sheet slot 46 and projects forward therefrom. The cassette is then placed flat onto the positioner 10 so that it rests on the shelves 70, 72 and is held between the forward stops 84, 86 and the back stops 88, 90.

Where actuator pins 108 are employed, they enter the corresponding cassette holes 54, 56 (FIG. 3) during the final cassette-inserting movement and thereby place the cassette clamping mechanism in the release position upon the final inserting motion of the cassette. Thus, as soon as the cassette is fully seated in the positioner, the film sheet 42 therein is fully engaged, and in registered alignment, with the print sheet 38. The clamping mechanism in the cassette is released, so that the pair of inter-engaged mated sheets 38, 42 is ready for withdrawal into the processor 12.

As soon as the mated sheets are withdrawn into the processor, the cassette can be removed from the positioner for reloading and further use. Similarly, the positioner is immediately ready for reloading with a fresh print sheet and another film sheet-bearing cassette.

It will thus be seen that this invention efficiently attains the objects set forth above, among those made apparent from the preceding description. Since certain changes may be made in the above construction without departing from the scope of the invention, all matter contained in the above description or shown in the accompanying drawings is to be interpreted as illustrative, and not in a limiting sense.

It is also to be understood that the following claims are intended to cover all of the generic and specific features of the invention described herein, and all statements of the scope of the invention which, as a matter of language, might be said to fall therebetween.

What is claimed is:

1. Apparatus for mating an exposed, photosensitive film sheet of the self-developing type with an image-receiving print sheet and for facilitating the presentation of the mated pair of film and print sheets to a sheet-receiving entry of a processor device, the film sheet having a forwardly extending tab and the print sheet having a leader flap provided with a slot adapted to receive the tab, therethrough, the film sheet being held in a cassette with the tab extending from a forward end of the cassette, said apparatus comprising:

means for attaching said apparatus to the film processor in position adjacent the entry of the processor;

tray means for receiving the print sheet in general alignment with the entry of the processor cassette-seating means for receiving and positioning the cassette in general registration with respect to the print sheet with the film-sheet tab extending from the forward end of the cassette, into the entry of the processor; and locating means for engaging said film-sheet tab and automatically guiding said tab into the print-sheet slot as the cassette is being received and positioned by said cassette-seating means, and for restraining the print sheet from moving toward the entry of the processor during said tab-slot engagement.

2. Apparatus of claim 1 wherein the cassette is of the type including releasable means for clamping the film sheet and said apparatus additionally comprises:

actuating means for engaging the releasable sheet-clamping means of the cassette upon the slidable receipt thereof in said cassette seating means, and for automatically actuating the cassette clamping-means to a sheet-releasing position.

3. Apparatus according to claim 1 wherein said locating means comprises at least one first resilient member secured thereto at one of its ends and terminating at its other end in an end portion in engagement with said tray means proximate the leading edge of the print sheet flap located in said tray means, said end portion being adapted to releasably engage the forward end of the print sheet leader to provide said restraint against forward motion of said print sheet during the tab-slot engagement.

4. Apparatus according to claim 3 wherein said locating means further includes at least one second resilient member secured thereto at one end and having a free end adapted to bear resiliently on the upper surface of the tray-located print sheet for positioning the print-sheet leader and for guiding the film-sheet tab into engagement with the print-sheet slot.

5. Apparatus according to claim 1 further comprising light-sealing means fitted to said seating means for providing a film sheet-passageway shielded from ambient light between the passage of a film sheet from a seated cassette to the processor entry.

6. Apparatus for positioning a cassette-housed film sheet in superposition with and in engagement with a print sheet of the type having a leading edge flap folded on itself with a slot at the fold, said apparatus comprising:

tray means for receiving and locating a print sheet;

cassette guiding and seating means fixedly mounted with respect to said tray means for slidably receiving a forward-moving and film sheet-bearing cassette and guiding the cassette into seated engagement superposed with said tray means;

locator means mounted with said tray means and said seating means and having a restraining member disposed for engaging a print sheet located in said tray means and releasably restricting forward movement thereof, and having a guiding member disposed for pressing on a print sheet located in said tray means and guiding into the print-sheet slot, a film-sheet tab extending forwardly from the cassette during the cassette-seating forward movement; and light-sealing means arranged with said seating means and providing a sheet-passageway shielded from ambient light, said passageway extending forward from the location of the extending-tab of a seated cassette.

7. Apparatus for mating an exposed, photosensitive film sheet of the self-developing type with an image-receiving print sheet and for facilitating the presentation of the mated pair of film and print sheets to a sheet-receiving entry of a film processor device, the film sheet having a forwardly extending tab and the print sheet having a leader flap provided with a slot adapted to receive the tab therethrough, the film sheet being held in a cassette with the tab extending from a forward end of the cassette, the cassette including a pair of longitudinally slidable operating rods operatively connected to cam surfaces for relieving a clamping pressure on the film sheet, said apparatus comprising:

means for releasably attaching said apparatus to the film processor in position adjacent the entry of the processor;

tray means for receiving and locating the print sheet in general alignment with the entry of the processor;

cassette-seating means for receiving and positioning the cassette in general registration with respect to the print sheet with the film-sheet tab extending from the forward end of the cassette, into the entry of the processor; and a locating member including at least one first resilient finger having a free angled end portion located proximate the leader of the print sheet located in said tray means, said angled end portion being adapted to releasably engage the forward end of the print sheet leader to provide restraint against forward motion of the print sheet during the tab-slot engagement and at least one second resilient finger having a free end adapted to bear resiliently on the upper surface of the tray-located print sheet leader in order to automatically guide the film-sheet tab into engagement with the print-sheet slot; and light-sealing means fitted to said cassette seating means for providing in cooperation with the film processor a film sheet-passageway shielded from ambient light between the passage of a film sheet from a seated cassette to the processor entry.

8. Apparatus according to claim 7 further comprising actuating means for engaging the cassette operating rods upon the slidable receipt thereof in said seating means, and for actuating the operating rods and the cam surfaces to a sheet releasing position.

9. Apparatus according to claim 8 wherein said actuating means includes a pair of pins mounted in said cassette-seating means and having a free end extending toward the cassette and adapted to engage the slide rods.

10. Apparatus according to claim 7 wherein the processor entry has a protrusion formed on a side wall thereof and wherein said releasable attachment means comprises spring detents that engage the protrustions.

11. Apparatus for mating an exposed, photosensitive film sheet of the self-developing type with an image-receiving print sheet and for facilitating the presentation of the mated pair of film and print sheets to a sheet-receiving entry of a processor device, the film sheet having a forwardly extending tab and the print sheet having a leader flap provided with a slot adapted to receive the tab therethrough, the film sheet being held in a cassette with the tab extending from a forward end of the cassette, the cassette including a pair of longitudinally slidable operating rods operatively connected to cam surfaces for relieving a clamping pressure on the film sheet, said apparatus comprising:

means for releasably attaching said apparatus to the film processor in position adjacent the entry of the processor;

a slide tray having a substantially flat bottom wall and lateral, longitudinally extending side walls that together receive and locate the print sheet in general alignment with the entry of the processor;

a divider panel located proximate the processor entry when said apparatus is attached to the processor and extending laterally between a forward portion of said side walls;

a cover located proximate the processor entry when said apparatus is attached to the processor, in spaced apart relation to said divider and extending laterally between a forward portion of said side walls, said divider panel, cover and side walls defining a cassette seating passage for slidably receiving the cassette with the film-sheet tab extending from the cassette leading end and for superposing the cassette with the print sheet;

a locating member formed of a resilient sheet material having one edge secured to said cover and having the opposite edge formed into a plurality of first resilient fingers having a free angled end portion located proximate the leader of the print sheet located in said slide tray, said angled end portion being adapted to releasably engage the forward end of the print sheet leader to provide restraint against forward motion of the print sheet during the tab-slot engagement and a plurality of second resilient fingers having a free end adapted to bear resiliently on the upper surface of the tray-located print sheet leader and for automatically guiding the film-sheet tab into engagement with the print-sheet slot;

light-sealing means fitted to said slide tray and cassette seating passage for providing a film sheet-passageway shielded from ambient light between the passage of a film sheet from a seated cassette to the processor entry; and actuating means for engaging the cassette operating rods upon the slidable receipt thereof in said seating means, and for actuating the operating rods and the cam surfaces to a sheet releasing position.

12. Apparatus according to claim 11 wherein said light sealing means comprises strips of light-absorbent pile fabric material secured to the transverse trailing edge of said cover and said divider panel and lips formed on said slide tray bottom wall and on said cover and adapted to engage corresponding portions of the processor entry in light-sealing relationship.

13. Apparatus according to claim 11 further comprising stops secured to said side walls for longitudinally locating the cassette when it is seated.

14. The apparatus of claim 1 wherein said means for attaching said apparatus to the film processor is releasable.

15. The apparatus of claim 1 wherein the cassette is of the type including releasable means for clamping the film sheet and said apparatus additionally comprises:

actuating means for engaging the releasable sheet-clamping means of the cassette, and for actuating the cassette clamping-means to a sheet-releasing position.

16. The apparatus of claim 3 wherein said tray means includes a frontal lip and said other end portion of said first resilient member is angled to overlap the edge of said frontal lip.

* * * * *